US005896156A

United States Patent [19]

Suzuki et al.

[11] Patent Number: 5,896,156

[45] Date of Patent: Apr. 20, 1999

[54] RECORDING METHOD AND APPARATUS FOR POSITIVELY ERASING AN IMAGE RECORDED ON A REVERSIBLE HEAT-SENSITIVE RECORDING MEDIUM

[75] Inventors: Akira Suzuki; Fumihito Masubuchi, both of Shizuoka, Japan

[73] Assignee: Ricoh Company, Ltd., Tokyo, Japan

[21] Appl. No.: 08/992,900

[22] Filed: Dec. 18, 1997

[51] Int. Cl.[6] ..... B41J 2/32; B41M 5/26

[52] U.S. Cl. ..... 347/171

[58] Field of Search ..... 347/171; 400/120.01

[56] References Cited

FOREIGN PATENT DOCUMENTS

| | | | |
|---|---|---|---|
| 4-44887 | 2/1992 | Japan . | |
| 5-4446 | 1/1993 | Japan . | |
| 9-141907 | 6/1997 | Japan | 347/171 |

*Primary Examiner*—Huan Tran

*Attorney, Agent, or Firm*—Oblon, Spivak, McClelland, Maier & Neustadt, P.C.

[57] ABSTRACT

A recording and erasure of a visible image on a reversible heat-sensitive recording medium can be repeatedly performed in a stable condition without failure. The visible image is recorded by a thermal recording head on the reversible heat-sensitive recording medium. The recording medium is provided with an unheated area which is not exposed to heat. The visible image is erased by providing heat by a thermal erasing head. The reversible heat-sensitive recording medium is provided with an unheated area which is unheated by the thermal erasing head. The unheated area substantially extends along at least one of sides of the reversible heat-sensitive recording medium. The unheated area prevents the reversible heat-sensitive recording medium from being warped when a erasing operation is repeated many times.

14 Claims, 11 Drawing Sheets

PRIOR ART

PRIOR ART

PRIOR ART

RECORDING METHOD AND APPARATUS FOR POSITIVELY ERASING AN IMAGE RECORDED ON A REVERSIBLE HEAT-SENSITIVE RECORDING MEDIUM

BACKGROUND OF THE INVENTION

1. Field of the Invention

The present invention relates to a recording method for recording and erasing an image on a reversible heat-sensitive recording medium and a recording apparatus using such a recording method and, more particularly, to a technique for preventing an occurrence of a trouble in a conveying process of the recording medium due to a deformation of the recording medium when a recording operation and an erasing operation are repeated.

2. Description of the Related Art

In recent years, a reversible heat-sensitive recording medium has come into widespread use for displaying various kinds of information. Such a reversible heat-sensitive recording medium is disclosed, for example, in Japanese Laid-Open Patent Application No.4-44887. The reversible heat-sensitive recording medium can be used for repeatedly recording and erasing an image by using a material having a characteristic in which a transparency is reversibly changed by changing a temperature of the material.

FIG. 1 shows a structure of a reversible heat-sensitive recording medium using the above-mentioned material. In FIG. 1, the reversible heat-sensitive recording medium 1 comprises a base film 31 made of a polyester film, a recording layer 34 applied on the base film 31 and an over-coating layer 35 protecting the recording layer 34. The recording layer 34 is made of a high polymer/low polymer composite type recording material which comprises a high polymer material 32 and an organic low-molecular material 33 dispersed in the high polymer material 32.

FIG. 2 is a graph showing a temperature-transpatency characteristic of a reversible heat-sensitive recording medium. The recording material of the recording layer 34 has a transparency which varies when it is heated or cooled as shown in FIG. 2. Specifically, when the recording material is at a room temperature below a temperature T1, the recording material is in a white, opaque-like state. This state is referred to as a state A which is a maximum white state. When the recording material is heated from room temperature, the transparency of the recording material starts to increase at a temperature T2, and the transparency becomes maximum at a temperature T3. This state is referred to as a state B which is a maximum transparency state. The maximum transparency is maintained even when the recording material in the maximum transparency state B is cooled to room temperature. This state is referred to as a state C. Then, when the recording material in the state C in which the recording material has maximum transparency at room temperature is heated again to a temperature T4 which is higher than the temperature T3 as indicated by a dashed line in FIG. 2, the transparency of the recording material assumes a state which is intermediate between the maximum transparency state and the maximum white state. This state is referred to as a state D. When the recording material in the state D is cooled to the state A which is at room temperature T1, the recording material returns to the maximum white, opaque-like state.

The above-mentioned phenomenon occurs when the organic low-molecular material 33 reversibly changes from a poly-crystalline state to a single-crystalline state due to temperature change which results in changes in the transparency of the recording layer 34. Thus, the reversible heat-sensitive recording medium 1 can be repeatedly used for recording and erasing an image thereon.

Japanese Laid-Open Patent Application No.5-4446 discloses a recording apparatus which repeats a recording and erasure of an image on the reversible heat-sensitive recording medium 1. This recording apparatus comprises a thermal recording head 5 and a thermal erasing head 6 as shown in FIG. 3. The reversible heat-sensitive recording medium 1 is conveyed by feed rollers 3 and platen rollers 4. The reversible heat-sensitive recording medium 1 being conveyed by the feed rollers 3 and the platen rollers 4 is detected by a position detecting sensor 36 which is located before the thermal erasing head 6. When the reversible heat-sensitive recording medium 1 is detected by the position detecting sensor 36, a temperature of the thermal erasing head 6 is rapidly increased to an erasing temperature at which the reversible heat-sensitive recoding medium 1 is changed to a transparent state before the reversible heat-sensitive recording medium 1 reaches the thermal erasing head 6. After the thermal erasing head 6 reaches the erasing temperature, a pulsed current is supplied to the thermal erasing head 6 so as to maintain the erasing temperature. Thus, the recording layer of the reversible heat-sensitive recording medium 1 is changed to a transparent state so as to erase a visible image formed by the white state. Thereafter, a new visible image is formed on the reversible heat-sensitive recording medium 1 by the thermal recording head 5. The reversible heat-sensitive recording medium 1 can be used many times by repeating the above-mentioned operation. Since the thermal erasing head 6 has a small heat capacity, the thermal erasing head 6 can be rapidly heated after the reversible heat-sensitive recording medium 1 which is conveyed by the feed rollers 3 is detected by the position detecting sensor 36. Thereby, a visible image erasing unit of the recording apparatus can be miniaturized and energy used by the visible image erasing unit can be saved.

In an erasing operation performed by the thermal erasing head 6, curling tends to occur in the reversible heat-sensitive recording medium 1 since the surface of the heat-sensitive recording medium is locally and strongly pressed and heated by the thermal erasing head 6. Accordingly, when an erasing operation and a recording operation are repeated, the reversible heat-sensitive recording medium is permanently deformed. Thus, there is a problem in that a jamming of the reversible heat-sensitive recording medium occurs in the recording apparatus while the reversible heat-sensitive recording medium is conveyed.

SUMMARY OF THE INVENTION

It is a general object of the present invention to provide an improved and useful recording method and apparatus in which the above-mentioned problem is eliminated.

A more specific object of the present invention is to provide a recording method and apparatus in which recording and erasure of an image on a reversible heat-sensitive recording medium can be repeatedly performed in a stable condition without failure due to a deformation occurring in the reversible heat-sensitive recording medium.

In order to achieve the above-mentioned objects, according to the present invention, an unheated area selecting unit is provided to a recording apparatus which repeatedly performs a recording operation and an erasing operation for a visible image on a reversible heat-sensitive recording medium by using a recording head and a thermal erasing head. When a visible image recorded on the reversible heat-sensitive recording medium is erased so as to record a new visible image, the unheated area selecting unit determines a timing for heating the thermal erasing head so that unheated areas provided on a front end portion and a rear end portion of the reversible heat-sensitive recording medium in a conveying direction are not heated and only a heated area in the middle of the recording medium in the conveying direction is heated by the thermal erasing head.

Additionally, the thermal erasing head is provided with a heat-generative resistor member which is divided into a plurality of fine pieces arranged in a direction perpendicular to the conveying direction of the reversible heat-sensitive recording medium. A part of the heat-generative resistor member to be heated is selected when the reversible heat-sensitive recording medium is conveyed so that predetermined areas on the left and right sides of the reversible heat-sensitive recording medium are not heated by the thermal erasing head. The selection of the part of the heat-generative resistor member to be heated is performed in accordance with the unheated areas of the reversible heat-sensitive recording medium which were previously determined by the unheated area selecting unit. Thus, a possibility of an occurrence of a heat deformation in the reversible heat-sensitive recording medium is reduced.

The possibility of an occurrence of a heat deformation in the reversible heat-sensitive recording medium is positively reduced by providing the unheated area on at least one of the sides of the reversible heat-sensitive recording medium. Additionally, by setting a range of the unheated area to at least 5 mm, a possibility of an occurrence of a heat deformation of the reversible heat-sensitive recording medium is reduced when a recording operation and an erasing operation are repeated. Thus, an occurrence of a trouble such as a jamming in the conveying path can be prevented.

Additionally, the possibility of occurrence of a heat deformation can be reduced by applying the reversible heat-sensitive recording medium on a plastic sheet so that the unheated area is formed by the plastic sheet even when the plastic sheet has a relatively low heat-resistance temperature.

It should be noted that the present invention can also be applied to an erasing apparatus which simply erases a visible image recorded on the reversible heat-sensitive recording medium.

Other objects, features and advantages of the present invention will become more apparent from the following detailed description when read in conjunction with accompanying drawings.

DETAILED DESCRIPTION OF THE PREFERRED EMBODIMENT

Figure 1:
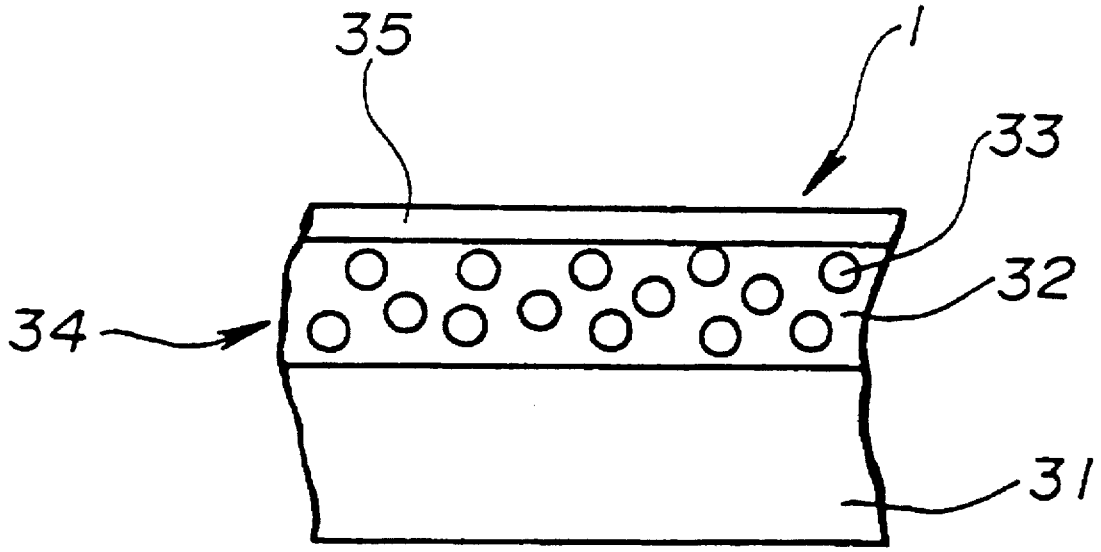
FIG. 1 is a cross-sectional view of a part of a reversible heat-sensitive recording medium.
Figure 2:
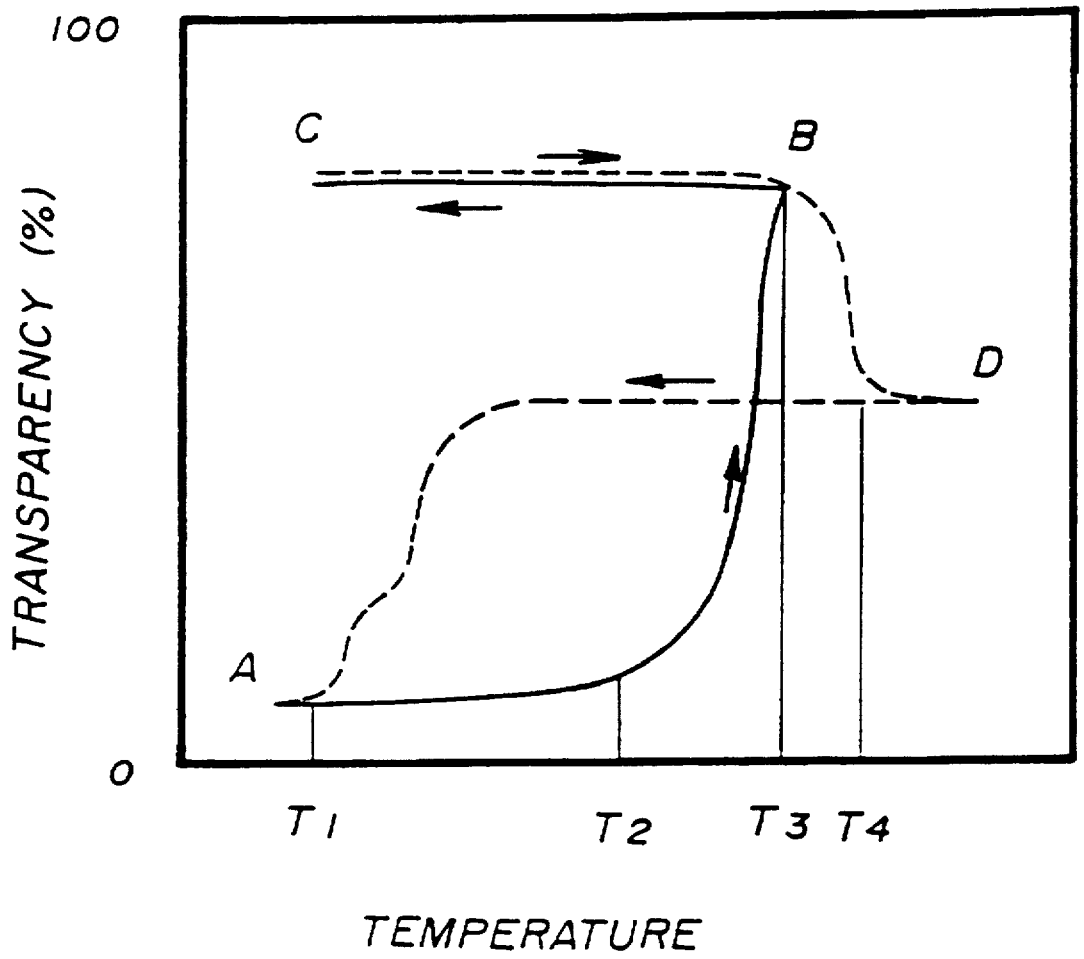
FIG. 2 is a graph showing a temperature-transpatency characteristic of the reversible heat-sensitive recording medium.
Figure 3:
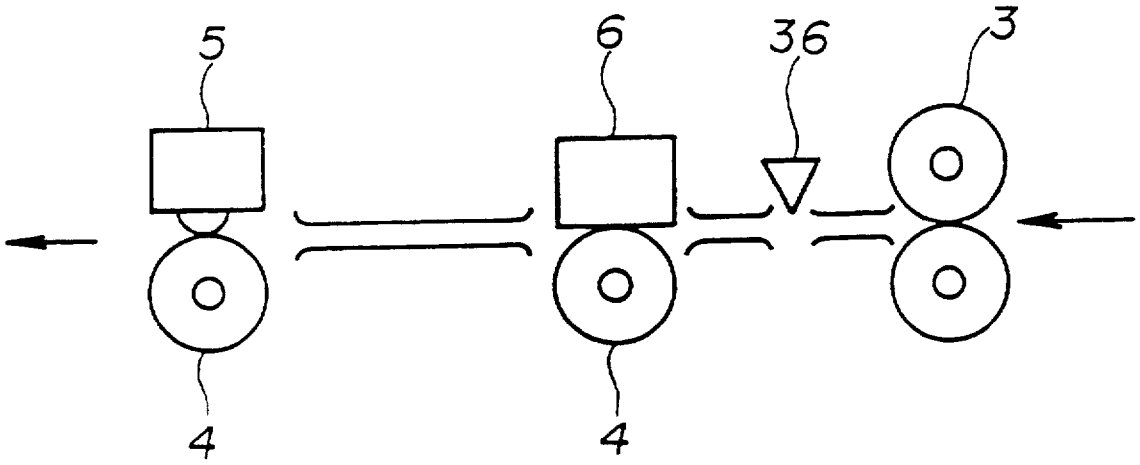
FIG. 3 is an illustration of a structure of a conventional recording apparatus for recording an image on the reversible heat-sensitive recording medium.
Figure 4:
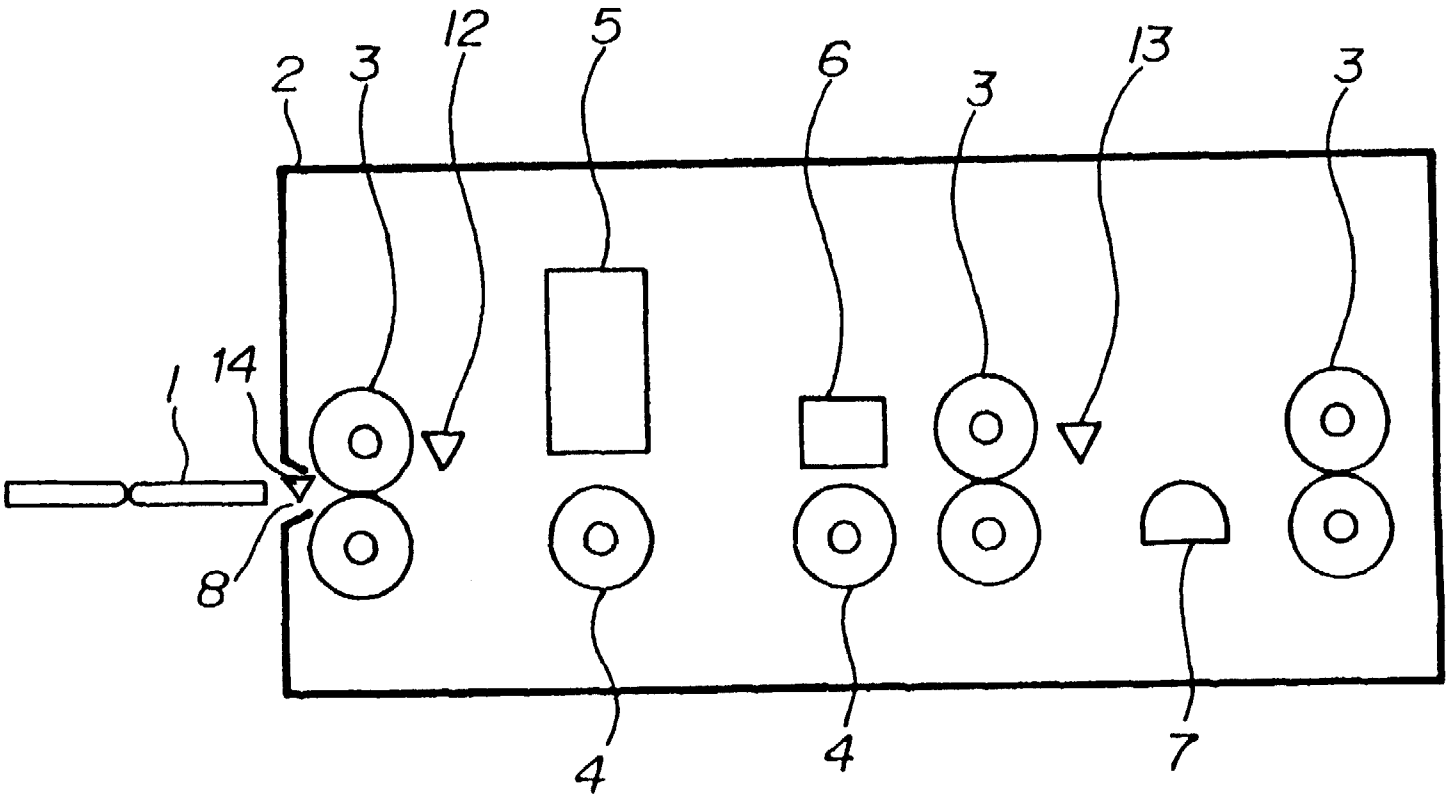
FIG. 4 is an illustration of a recording apparatus according to a first embodiment of the present invention.

A description will now be given of a first embodiment of the present invention. FIG. 4 is an illustration of a recording apparatus according to the first embodiment of the present invention. In FIG. 4, parts that are the same as the parts shown in FIGS. 1 and 3 are given the same reference numerals.

The recording apparatus 2 shown in FIG. 4 records a visible image on the reversible heat-sensitive recording medium 1 and also erases the visible image recorded on the reversible heat-sensitive recording medium 1. The recording apparatus 2 comprises, as shown in FIG. 4, a plurality of feed rollers 3, a plurality of platen rollers 4, a thermal recording head 5, a thermal erasing head 6 and a magnetic head 7. The thermal recording head 5, the thermal erasing head 6 and the magnetic head 7 are arranged in that order along a conveying path of the reversible heat-sensitive recording medium 1 from a recording medium insertion opening 8.

Figure 5:
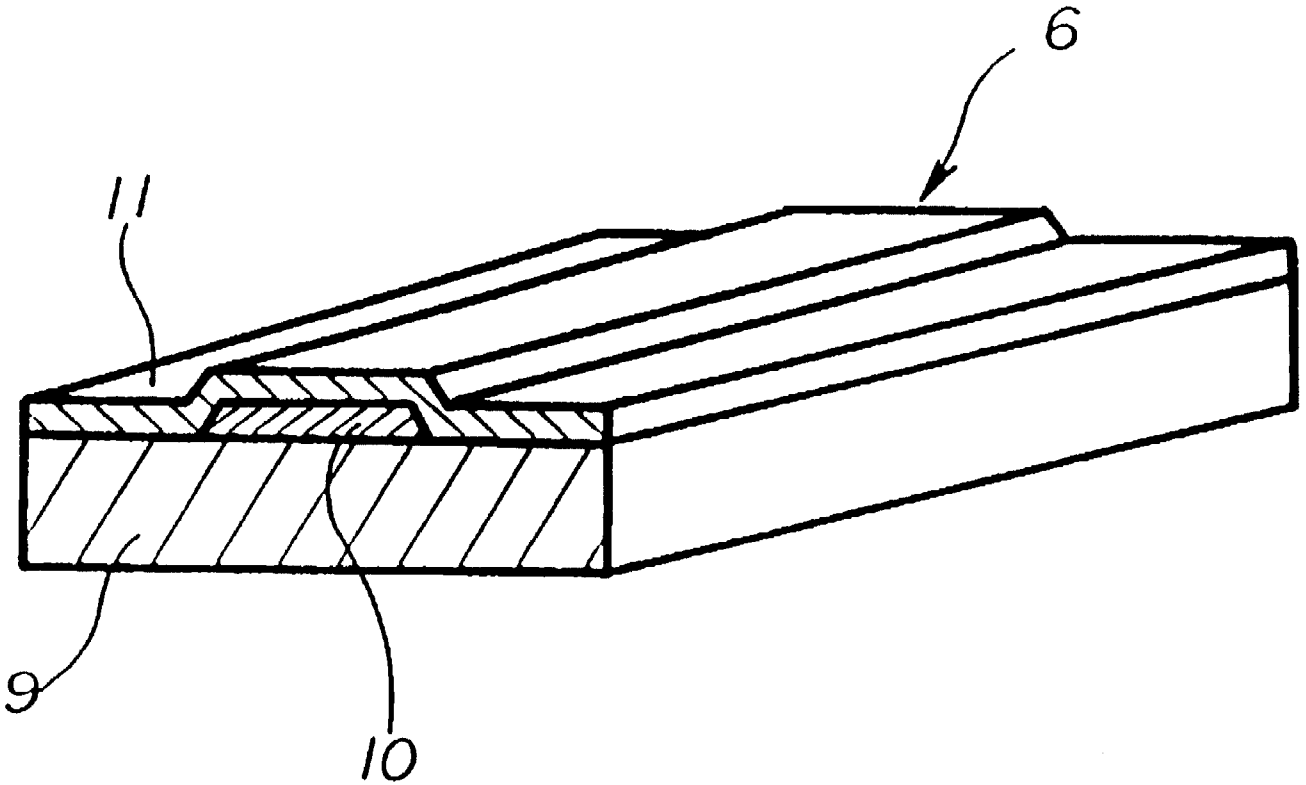
FIG. 5 is a perspective view of a thermal erasing head shown in FIG. 4.
Figure 5A:
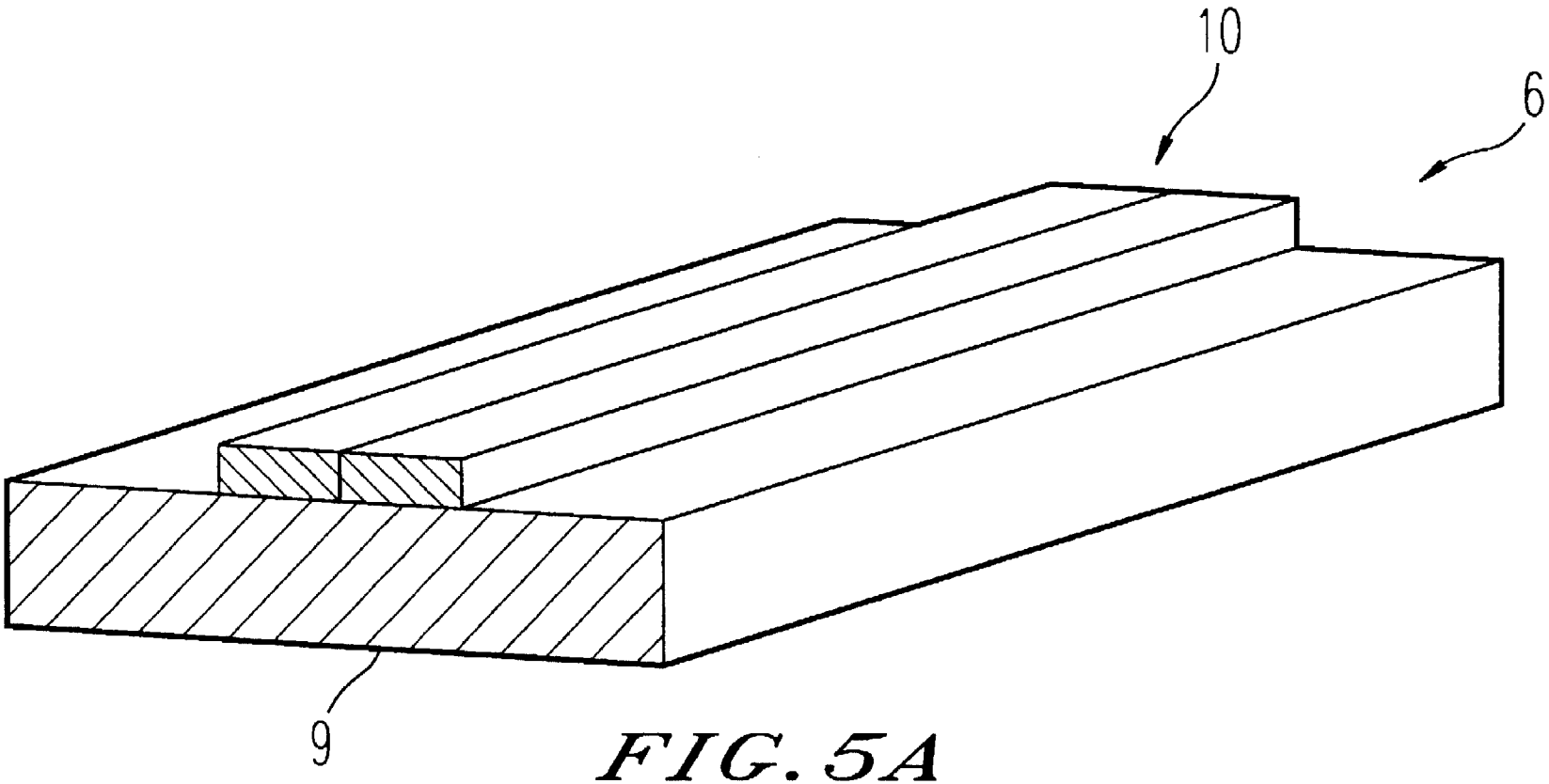
FIG. 5A is a perspective view of the thermal erasing head shown in FIG. 5.

The thermal recording head 5 shown in FIG. 4 records a visible image on the reversible heat-sensitive recording medium 1. The thermal erasing head 6 erases a visible image recorded on a display area **1*b* of the reversible heat-sensitive recording medium 1 shown in FIG. 6 by providing a heat to the display area 1*b*. FIG. 5 is a perspective view of the thermal erasing head 6. As shown in FIG. 5, the thermal erasing head 6 comprises a ceramic substrate 9 having a thickness of 1 mm, a film-like heat generating resistor member 10 formed on the ceramic substrate 9 and a protective film 11 covering a resistor member 10. In this embodiment, the resistor member 10 has a thickness of 2 μm and a width of 2 mm. A longitudinal direction of the resistor member 10 is perpendicular to an extending direction of the conveying path of the reversible heat-sensitive recording medium 1. The protective film 11 is made of a crystalline glass. A pulsed current is provided to the resistor member 10 so as to heat an outer surface of the protective film 11 at a predetermined constant temperature. The visible image recorded on the reversible heat-sensitive recording medium 1 is erased by the heated surface of the protective film 11 of the thermal erasing head 6**.

Figure 6:
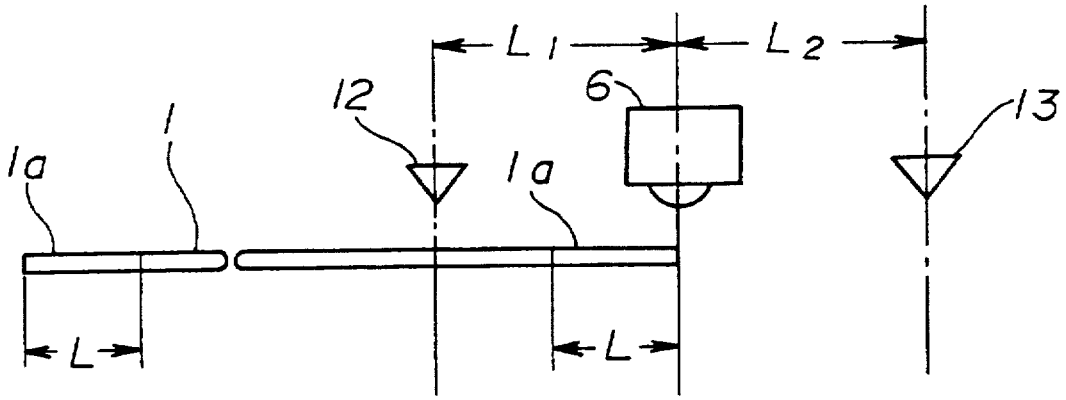
FIG. 6 is an illustration showing positions of a front end detecting sensor and a rear end detecting sensor with respect to the thermal erasing head shown in FIG. 4.

As mentioned above, by constituting the thermal erasing head 6 by the film-like heat generating resistor member 10 having a belt-like shape which is provided on the ceramic substrate 9, the heat capacity of the thermal erasing head 6 can be reduced which results in an increase in a heating speed and a cooling speed and an even heating of the reversible heat-sensitive recording medium 1. Additionally, by covering the film-like heat generating resistor member 10 with the protective film 11 made of a crystalline glass, the reversible heat-sensitive recording medium 1 is prevented from being damaged by the thermal erasing head 6. As shown in FIG. 6, a front end detecting sensor 12 is provided on the side of the thermal recording head 5 with respect to the thermal erasing head 6 at a predetermined distance L1 away from the thermal erasing head 6. Additionally, a rear end detecting sensor 13 is provided on the side of the magnetic head 7 with respect to the thermal erasing head 6 at a predetermined distance L2 away from the thermal erasing head 6. Further, a reverse detecting sensor 14 is provided on the inner end of the conveying path in the recording apparatus.

Figure 7:
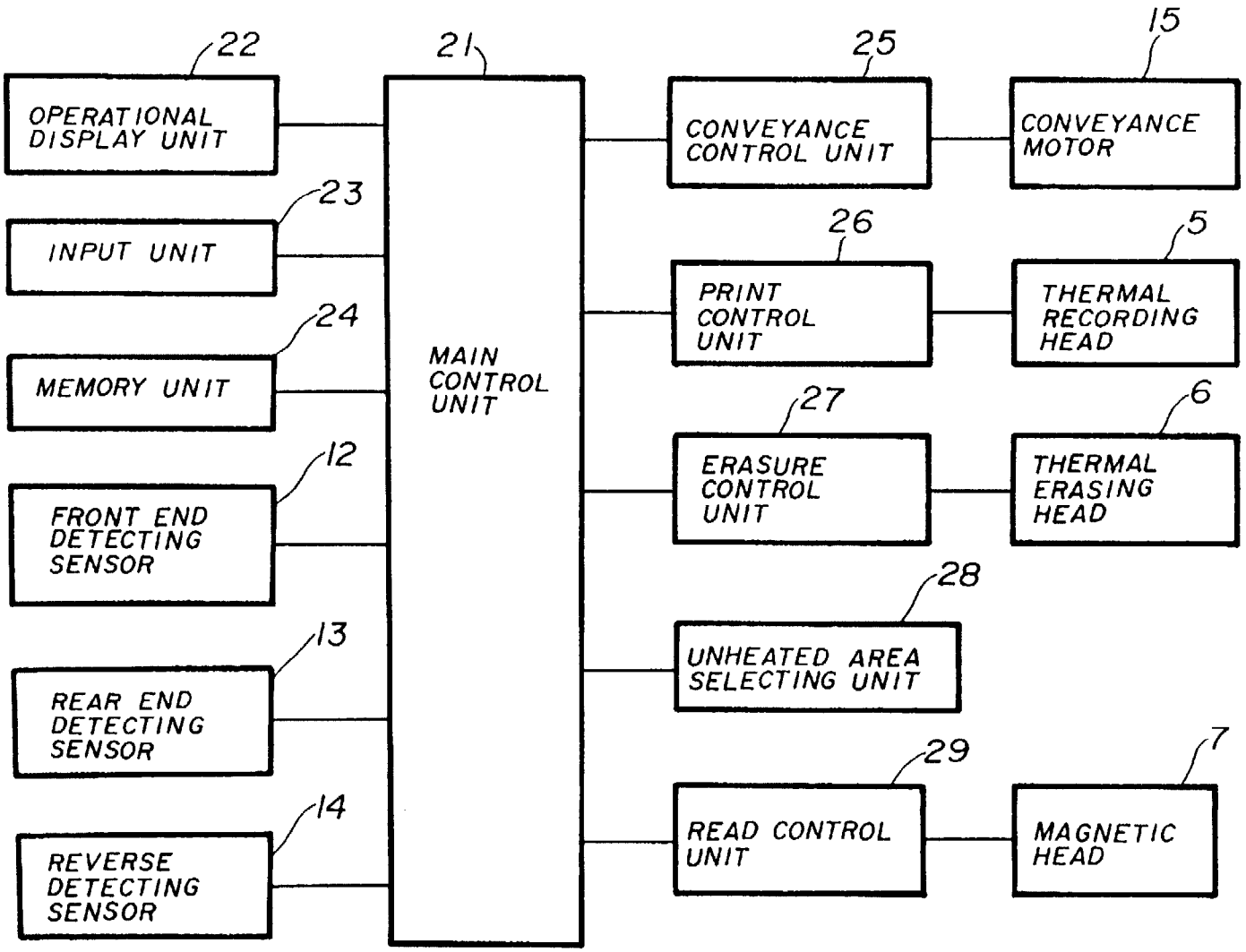
FIG. 7 is a block diagram of a control unit of the recording apparatus shown in FIG. 4.

FIG. 7 is a block diagram of a control unit of the recording apparatus shown in FIG. 4. The control unit of the recording apparatus according to the present embodiment comprises a main control unit 21, an operational display unit 22, an input unit 23, a memory unit 24, a conveyance control unit 25, a print control unit 26, an erasure control unit 27, an unheated area selecting unit 28 and a read control unit 29. The main control unit 21 controls operations of the entire recording apparatus 2. The operational display unit 22 instructs a recording operation and an erasing operation performed on the reversible heat-sensitive recording medium 1, and instructs the unheated area which is not heated by the thermal erasing head and displays an operational state of the recording apparatus 2. The input unit 23 inputs information which is to be recorded on the reversible heat-sensitive recording medium 1, and stores the information in the memory unit 24. Information with respect to a length L of the unheated area 1*a* (shown in FIG. 6) which is provided to the front end portion and the rear end portion of the reversible heat-sensitive recording medium 1 is previously stored in the memory unit 24. The conveyance control unit 25 drives a conveyance motor 15 which drives each of the feed rollers 3. The conveyance control unit 25 also controls normal and reverse rotations of the conveyance motor 15. The print control unit 26 controls a recording operation of the thermal recording head 5. The erasure control unit 27 controls a current provided to the thermal erasing head 6 so as to control a temperature of a surface of the thermal erasing head 6 at a constant temperature. The unheated area selecting unit 28 selects a timing for contacting the thermal erasing head 6 to the reversible heat-sensitive recording medium 1 and a time range of the contact in accordance with the range and position of the unheated area 1*a* which is stored in the memory unit 24 or instructed through the operational display unit 22. The read control unit 29 controls a reading operation performed by the magnetic head 7.

Figure 8:
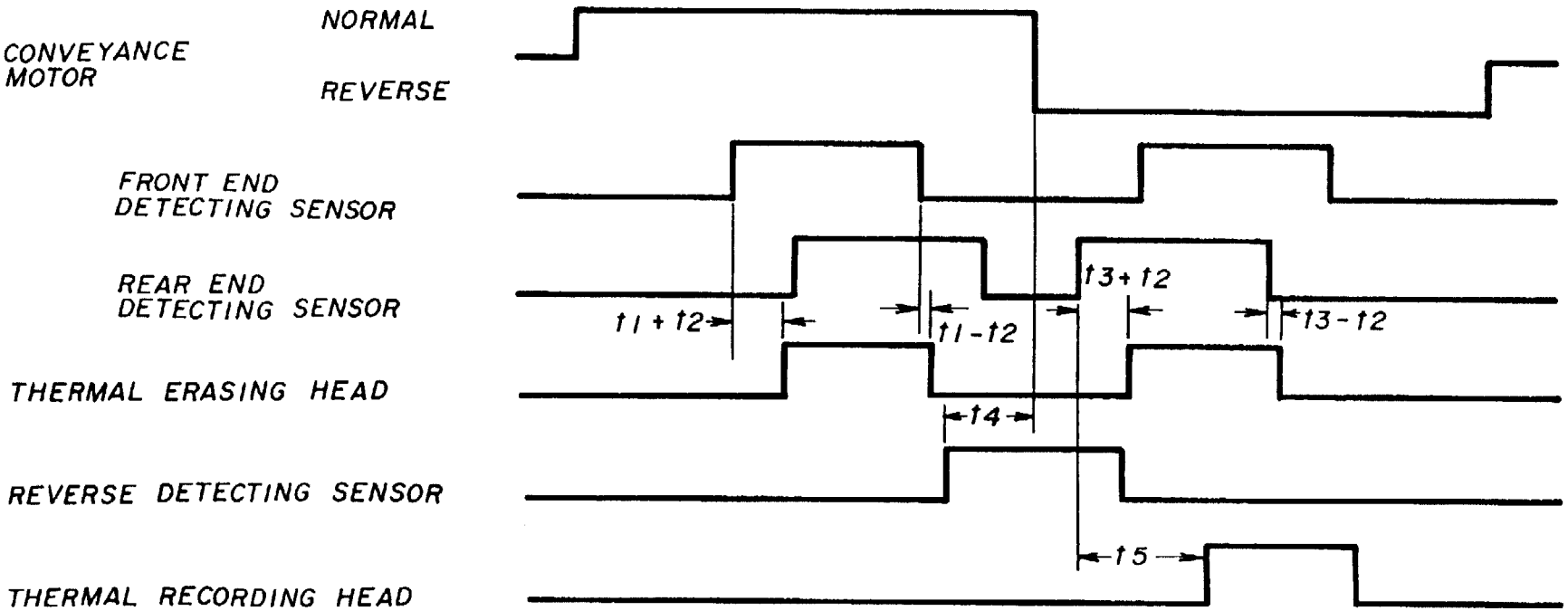
FIG. 8 is a time chart of an erasing operation and a recording operation performed by the recording apparatus shown in FIG. 4.

A description will now be given, with reference to FIG. 8, of an erasing operation and a subsequent recording operation performed by the recording apparatus 2. FIG. 8 is a time chart of the erasing operation and the recording operation performed by the recording apparatus 2.

When the reversible heat-sensitive recording medium 1 is inserted into a recording medium insertion opening 8 and a recording and erasure is instructed by the operational display unit 22, the main control unit 21 instructs the conveyance control unit 25 to convey the reversible heat-sensitive recording medium 1. The conveyance control unit 25 rotates the conveyance motor 15 at a constant speed in a normal direction when conveyance of the reversible heat-sensitive recording medium 1 is instructed. Accordingly, the feed rollers 3 are rotated by the rotation of the conveyance motor 15, and the reversible heat-sensitive recording medium 1 is conveyed along the thermal recording head 5, the thermal erasing head 6 and the magnetic head 7. Then, when a trailing edge (rear end) of the reversible heat-sensitive recording medium 1 is detected by the reverse detection sensor 14, the conveyance control unit 25 rotates the conveyance motor 15 in a reverse direction after a predetermined time t4 is elapsed. Thus, the feed rollers 3 are reversely rotated to convey the reversible heat-sensitive recording medium 1 toward the recording medium insertion opening 8. During the above-mentioned reciprocation of the reversible heat-sensitive recording medium 1, the reversible heat-sensitive recording medium 1 is heated so as to erase the visible image and record a new visible image by the thermal recording head 5.

When the conveyance of the reversible heat-sensitive recording medium 1 is started, the unheated area selecting unit 28 calculates a time t1 which is a period for the front end of the reversible heat-sensitive recording medium 1 to reach the thermal erasing head 6 after it is detected by the front end detecting sensor 12 based on the distance L1 between the front end detecting sensor 12 and the thermal erasing head 6 and a conveyance speed V of the reversible heat-sensitive recording medium 1. The unheated area selecting unit 28 also calculates a time t2 which is a period for the unheated area 1*a* of the reversible heat-sensitive recording medium 1 to pass the thermal erasing head 6 based on the length L of the unheated area 1*a* and the conveyance speed V of the reversible heat-sensitive recording medium 1. Then, the calculated time t1 and the calculated time t2 are summed to obtain a summed value (t1+t2) which corresponds to a timing to start a heating of the thermal erasing head 6. The calculated time t2 is subtracted from the calculated time t1 to obtain a subtracted value (t1−t2) which corresponds to a timing to end the heating of the thermal erasing head 6. The summed value (t1+t2) and the subtracted value (t1−t2) are sent to the erasure control unit 27. The erasure control unit 27 supplies a current to the thermal erasing head 6 when the period (t1+t2) has passed since the front end of the reversible heat-sensitive recording medium 1 is detected by the front end detecting sensor 12. Accordingly, the thermal erasing head 6 is heated at a constant temperature so as to heat the reversible heat-sensitive recording medium 1 at a temperature near the temperature at which the reversible heat-sensitive recording medium 1 becomes transparent. When the reversible heat-sensitive recording medium 1 is proceeded and the rear end of the reversible heat-sensitive recording medium 1 is detected by the front end detecting sensor 12, the erasure control unit 27 stops the current supplied to the thermal erasing head 6 after the period (t1−t2) has elapsed since the rear end was detected.

When the front end of the reversible heat-sensitive recording medium 1 is detected, the direction of travel of the reversible heat-sensitive recording medium 1 is reversed. Then, the unheated area selecting unit 28 calculates a time t3 which is a period for the rear end of the reversible heat-sensitive recording medium 1 to reach the thermal erasing head 6 after it is detected by the rear end detecting sensor 13 based on the distance L2 between the rear end detecting sensor 13 and the thermal erasing head 6 and a conveyance speed V of the reversible heat-sensitive recording medium 1. The unheated area selecting unit 28 also calculates the time t2 which is a period for the unheated area 1*a* of the reversible heat-sensitive recording medium 1 to pass the thermal erasing head 6 based on the length L of the unheated area 1*a* and the conveyance speed V of the reversible heat-sensitive recording medium 1. Then, the calculated time t3 and the calculated time t2 are summed to obtain a summed value (t3+t2) which corresponds to a timing to start heating the thermal erasing head 6. The calculated time t2 is subtracted from the calculated time t3 to obtain a subtracted value (t3−t2) which corresponds to a timing to end the heating of the thermal erasing head 6. The summed value (t3+t2) and the subtracted value (t3−t2) are sent to the erasure control unit 27. The erasure control unit 27 supplies a current to the thermal erasing head 6 when the period (t3+t2) has passed since the rear end of the reversible heat-sensitive recording medium 1 was detected by the rear end detecting sensor 13. Accordingly, the thermal erasing head 6 is heated at a constant temperature so as to heat the reversible heat-sensitive recording medium 1 at the temperature at which the reversible heat-sensitive recording medium 1 becomes transparent. When the reversible heat-sensitive recording medium 1 is proceeded and the front end of the reversible heat-sensitive recording medium 1 is detected by the rear end detecting sensor 13, the erasure control unit 27 stops the current supplied to the thermal erasing head 6 after the period (t3−t2) has elapsed since the front end was detected.

As mentioned above, by controlling the timing of starting and ending the heating process for the thermal erasing head 6, the area of the reversible heat-sensitive recording medium 1 other than the unheated area 1*a* can be heated so as to erase a visible image recorded on the reversible heat-sensitive recording medium 1.

When the conveyance motor 15 is reversed so as to reverse the direction of travel of the reversible heat-sensitive recording medium 1 and the rear end of the reversible heat-sensitive recording medium 1 is detected by the rear end detecting sensor 13, a recording operation of the thermal recording head 5 is started after a predetermined time t5 is passed so that a new visible image is recorded on the reversible heat-sensitive recording medium 1. After the reversible heat-sensitive recording medium 1 on which the new visible image is recorded is ejected from the recording medium insertion opening 8, the erasing and recording operation is ended.

Figure 9:
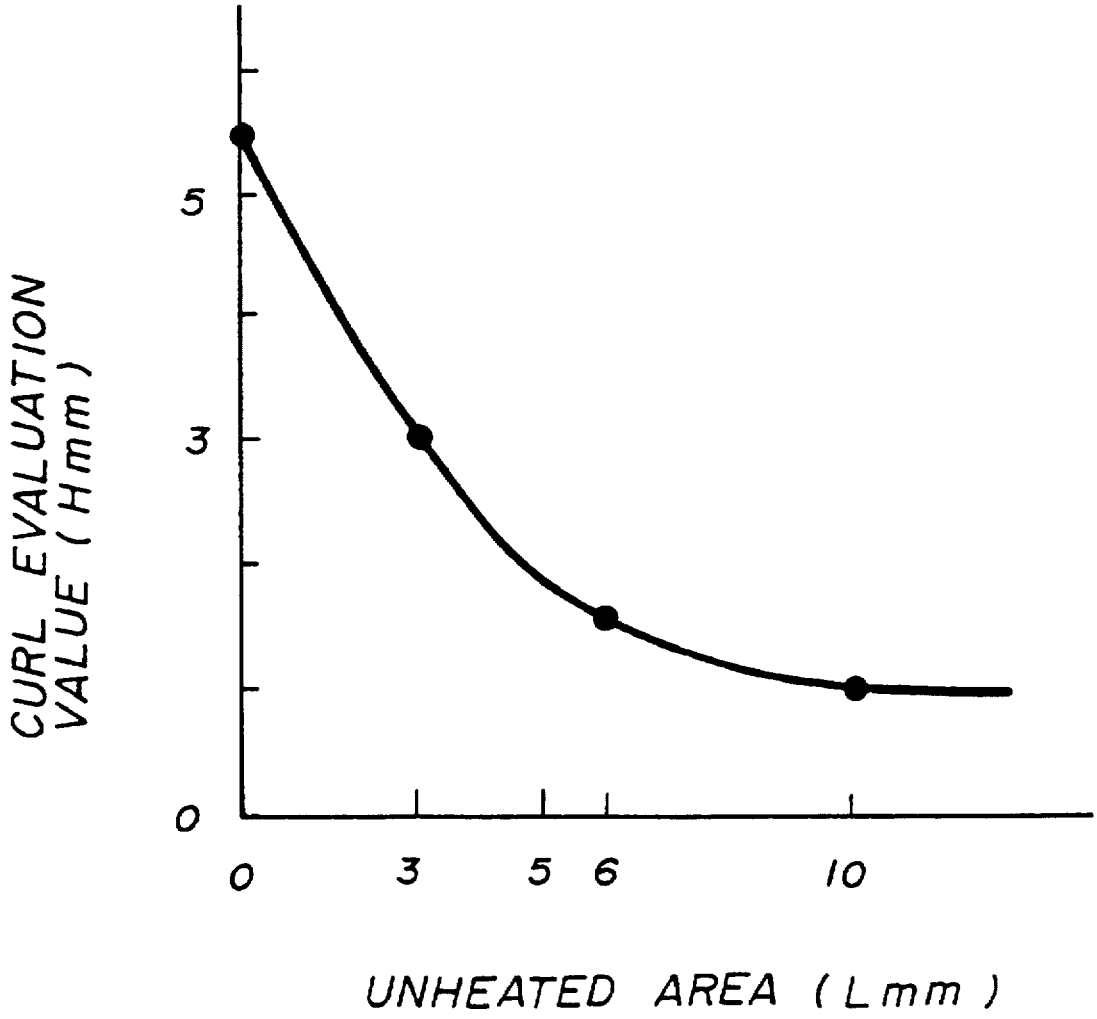
FIG. 9 is a graph showing a result of experiments in which an erasing and recording operation was repeated twenty (20) times for various lengths L of an unheated area shown in FIG. 6.

A description will now be given of the result of experiments performed by using the recording apparatus 2 according to the present embodiment. FIG. 9 is a graph showing a result of experiments in which an erasing and recording operation was repeated twenty (20) times for various lengths L of the unheated area 1*a*.

Figure 10:
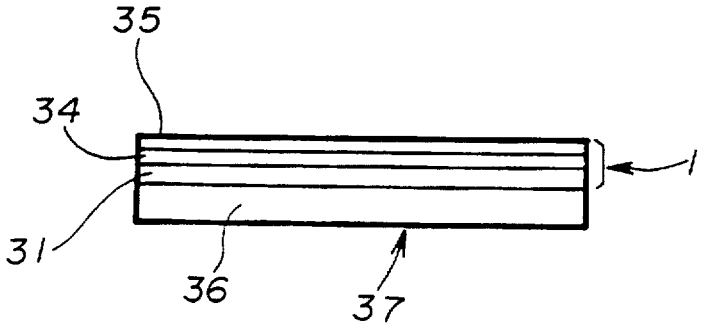
FIG. 10 is a side view of the reversible heat-sensitive recording medium which was used in the experiments.

FIG. 10 is a side view of the reversible heat-sensitive recording medium 1 which was used in the experiments. As shown in FIG. 10, the reversible heat-sensitive recording medium 1 comprises a base film 31 made of a polyester film, a recording layer 34 provided on the base film and an over-coating layer 35 provided on the recording layer 34. The reversible heat-sensitive recording medium 1 was applied on a polyvinyl chloride sheet 36 having a thickness of 780 μm so as to form a card 37 having an overall length of 85 mm. An evaluation value for evaluating a degree of curling of the card 37 is represented by a height H of a center of the card 37 with respect to opposite ends of the card 37.

As shown in FIG. 9, when the unheated area 1*a* was not provided on the reversible heat-sensitive recording medium 1, the evaluation value of curling was 5.5 mm. When the length L of the unheated area 1*a* was 3 mm, the evaluation value of curling was 3 mm. When the length L of the unheated area 1*a* was 6 mm, the evaluation value of curling was 1.5 mm. When the length L of the unheated area 1*a* was 10 mm, the evaluation value of curling was 1.0 mm.

If the evaluation value of curling exceeds 3 mm, trouble such as a jam may occur during a conveyance of the reversible heat-sensitive recording medium 1. Thus, in order to eliminate such a problem, the length L of the unheated area 1*a* must be more than 3 mm. When safety is considered, the length L of the unheated area 1*a* is preferably more that 5 mm. More preferably, the length L should be more than 10 mm so as to prevent an occurrence of a curl even if the erasing and recording operation is performed more than fifty (50) times.

Figure 11A:
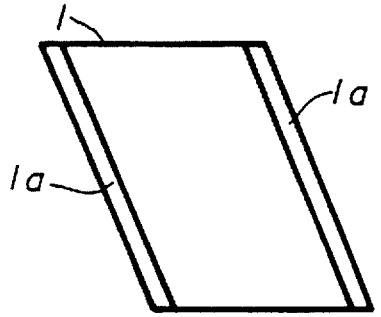
FIG. 11A is an illustration of a reversible heat-sensitive recording medium having an unheated area on the left and right sides.
Figure 11B:
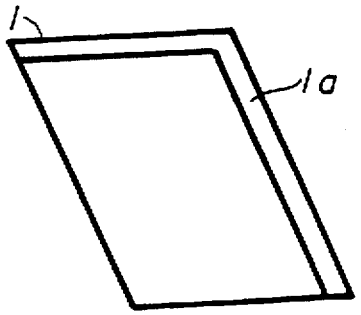
FIG. 11B is an illustration of a reversible heat-sensitive recording medium having an unheated area on one of the front and rear ends and one of the right and left sides.
Figure 11C:
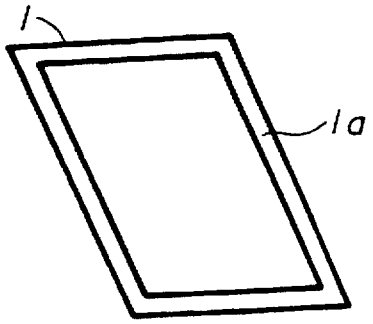
FIG. 11C is an illustration of a reversible heat-sensitive recording medium having an unheated area on each side.

In the above-mentioned embodiment, the unheated area 1*a* is provided on each end of the reversible heat-sensitive recording medium 1 in the conveying direction. However, the unheated area 1*a* may be provided on each side of the reversible heat-sensitive recording medium 1*a* as shown in FIG. 11A, or may be provided on one of the front and rear ends in the conveying direction and one of the left and right sides of the reversible heat-sensitive recording medium 1 as shown in FIG. 11B. The unheated area 1*a* may be provided on each side of the reversible heat-sensitive recording medium 1 as shown in FIG. 11C.

When the unheated area 1*a* is provided on at least one of the left and right sides of the reversible heat-sensitive recording medium 1, the thermal erasing head 6 may be formed by a heat generating resistor element comprising a plurality of heating elements arranged in a direction perpendicular to the conveying direction of the reversible heat-sensitive recording medium 1. According to such a construction of the thermal erasing head 6, a range of an area heated by the thermal erasing head 6 can be varied by selecting a range of the unheated area 1*a* by the unheated area selecting unit 28. Alternatively, a width of the thermal erasing head 6 in the direction perpendicular to the conveying direction of the reversible heat-sensitive recording medium 1 may be set to a width which eliminates the unheated area 1*a*.

A description will now be given of the result of experiments performed by using the recording apparatus 2 according to the present embodiment in which the unheated area 1*a* is provided on each side of the reversible heat-sensitive recording medium 1 formed as the card 37 shown in FIG. 10. In the experiments, the length L of the unheated area 1*a* was set to 3 mm or 6 mm. The following Table 1 shows the result of the experiments.

TABLE 1

| | Length L (mm) | | Evaluation |
|---|---|---|---|
| Sample | Front and Rear | Left and Right | Value H |
| A | 3 mm | 3 mm | 2 mm |
| B | 6 mm | 6 mm | 1 mm |

As appreciated from the Table 1, when the unheated area 1*a* was provided on each side of the reversible heat-sensitive recording medium 1 and the width of the unheated area was set to 3 mm, the evaluation value for curling was able to be reduced to as low as 2 mm.

In the above-mentioned experiments, the unheated area 1*a* was provided on the reversible heat-sensitive recording medium 1 since the reversible heat-sensitive recording medium 1 covers an entire surface of the plastic sheet 36 so as to form the card 37. However, the overall size of the plastic sheet 36 may be larger than the overall size of the reversible heat-sensitive recording medium 1 so that the unheated area is formed by an area of the plastic sheet which is not covered by the reversible heat-sensitive recording medium 1. In such a case, the plastic sheet 36 can be made from polyvinyl chloride, ABS resin or polycarbonate resin. Since the periphery of the plastic sheet 36 is not heated, the plastic sheet 36 can be made from polyvinyl chloride having a relatively low heat resistance temperature.

The following Table 2 shows the result of experiments in which the reversible heat-sensitive recording medium 1 was provided on a polyvinyl chloride sheet 36 having a size larger than the reversible heat-sensitive recording medium 1.

TABLE 2

| | Length L (mm) | | Evaluation |
|---|---|---|---|
| Sample | Front and Rear | Left and Right | Value H |
| C | 5 mm | 0 mm | 1 mm |
| D | 5 mm | 5 mm | 1 mm |
| E | 15 mm | 35 mm | 0 mm |

As appreciated from the above Table 2, a possibility of occurrence of curling in the reversible heat-sensitive recording medium 1 can be further reduced by providing the unheated area 1*a* to the plastic sheet 36.

It should be noted that the present invention can also be applied to a recording apparatus in which the thermal erasing head 6 is located on the upstream side of the thermal recording head 5 and the reversible heat-sensitive recording medium 1 is moved in one way.

Additionally, although the present invention is related to the recording apparatus which records a new visible image after erasing a visible image previously recorded on the reversible heat-sensitive recording medium, the present invention may be applied to an erasing apparatus which simply erases a visible image recorded on the reversible heat-sensitive recording medium 1.

The present invention is not limited to the specifically disclosed embodiments, and variations and modifications may be made without departing from the scope of the present invention.

What is claimed is:

1. A recording method for repeatedly recording and erasing a visible image on a reversible heat-sensitive recording medium, the visible image being recorded on said reversible heat-sensitive recording medium by a thermal recording head after a previously recorded visible image has been erased by providing heat generated by a thermal erasing head, said recording method comprising the steps of:

a) determining a portion of said reversible heat-sensitive recording medium to be heated by said thermal erasing head so as to provide an unheated area which is unheated by said thermal recording head;

b) heating said portion of said reversible heat-sensitive recording medium, other than said unheated area, by said thermal erasing head so as to erase a visible image previously recorded on said reversible heat-sensitive recording medium; and c) recording a new visible image on said portion of said reversible heat-sensitive recording medium by said thermal recording head.

2. The recording method as claimed in claim 1, wherein said determining step determines that said unheated area extends along at least one of front and rear sides and left and right sides of said reversible heat-sensitive recording medium.

3. The recording method as claimed in claim 1, wherein said determining step determines that said unheated area extends along each of front and rear sides of said reversible heat-sensitive recording medium.

4. The recording method as claimed in claim 1, wherein said determining step determines that said unheated area extends along each of left and right sides of said reversible heat-sensitive recording medium.

5. The recording method as claimed in claim 1, wherein said determining step determines that said unheated area extends along each of front and rear sides and left and right sides of said reversible heat-sensitive recording medium.

6. The recording method as claimed in claim 2, wherein said determining step determines that said unheated area has a width of at least 5 mm, said width being measured in a direction perpendicular to a longitudinal direction of said unheated area.

7. The recording method as claimed in claim 1, further comprising:

providing said reversible heat-sensitive recording medium with a supporting member on which the recording medium is applied, wherein said determining step determines that said unheated area is provided on said supporting member.

8. The recording method as claimed in claim 7, further comprising:

providing said supporting member as a plastic sheet.

9. A recording apparatus for repeatedly recording and erasing a visible image on a reversible heat-sensitive recording medium, said recording apparatus comprising:

a thermal recording head for recording the visible image on said reversible heat-sensitive recording medium;

a thermal erasing head for erasing the visible image recorded on said reversible heat-sensitive recording medium by providing heat to said reversible heat-sensitive recording medium; and an unheated area selecting unit for determining a start and end time of heating said thermal erasing head in accordance with a predetermined unheated area provided on said reversible heat-sensitive recording medium when said reversible heat-sensitive recording medium is conveyed in said recording apparatus.

10. A recording apparatus for repeatedly recording and erasing a visible image on a reversible heat-sensitive recording medium, said recording apparatus comprising:

a thermal recording head for recording the visible image on said reversible heat-sensitive recording medium;

a thermal erasing head for erasing the visible image recorded on said reversible heat-sensitive recording medium by providing heat to said reversible heat-sensitive recording medium, said thermal erasing head including a heat-generative resistor member divided into a plurality of fine pieces arranged in a direction perpendicular to a conveying direction of said reversible heat-sensitive recording medium in said recording apparatus; and an unheated area selecting unit for determining a portion of said heat-generative resistor member to be heated in accordance with a predetermined unheated area provided on said reversible heat-sensitive recording medium when said reversible heat-sensitive recording medium is conveyed in said recording apparatus.

11. An erasing method for repeatedly erasing a visible image recorded on a reversible heat-sensitive recording medium by providing heat generated by a thermal erasing head, said erasing method comprising the steps of:

a) determining a portion of said reversible heat-sensitive recording medium to be heated by said thermal erasing head so as to provide an unheated area which is unheated by said thermal recording head; and b) heating said portion of said reversible heat-sensitive recording medium, other than said unheated area, by said thermal erasing head so as to erase a visible image previously recorded on said reversible heat-sensitive recording medium.

12. The erasing method as claimed in claim 11, wherein said determining step determines that said unheated area extends along at least one of front and rear sides and left and right sides of said reversible heat-sensitive recording medium.

13. An erasing apparatus for repeatedly erasing a visible image on a reversible heat-sensitive recording medium, said erasing apparatus comprising:

a thermal erasing head for erasing the visible image recorded on said reversible heat-sensitive recording medium by providing heat to said reversible heat-sensitive recording medium; and an unheated area selecting unit for determining a start and end time of heating said thermal erasing head in accordance with a predetermined unheated area provided on said reversible heat-sensitive recording medium when said reversible heat-sensitive recording medium is conveyed in said erasing apparatus.

14. An erasing apparatus for repeatedly erasing a visible image on a reversible heat-sensitive recording medium, said erasing apparatus comprising:

a thermal erasing head for erasing the visible image recorded on said reversible heat-sensitive recording medium by providing heat to said reversible heat-sensitive recording medium, said thermal erasing head including a heat generative resistor member divided into a plurality of fine pieces arranged in a direction perpendicular to a conveying direction of said reversible heat-sensitive recording medium in said erasing apparatus; and an unheated area selecting unit for determining a portion of said heat generative resistor member to be heated in accordance with a predetermined unheated area provided on said reversible heat-sensitive recording medium when said reversible heat-sensitive recording medium is conveyed in said erasing apparatus.

* * * * *